United States Patent [19]

Hase

[11] 4,170,439

[45] Oct. 9, 1979

[54] TWIN AIR PUMP

[76] Inventor: Masahiro Hase, 12-102 Mogusadanchi, 1261 Wada, Tama-shi, Tokyo, Japan

[21] Appl. No.: 867,055

[22] Filed: Jan. 5, 1978

[51] Int. Cl.[2] ..... F04B 21/02

[52] U.S. Cl. ..... 417/413; 417/538

[58] Field of Search ..... 417/413, 396, 395, 538, 417/471, 458

[56] References Cited

U.S. PATENT DOCUMENTS

| | | | |
|---|---|---|---|
| 1,912,202 | 5/1933 | Hueber | 417/396 |
| 2,707,485 | 5/1955 | Saalfrank | 417/458 X |
| 2,809,589 | 10/1957 | Randolph | 417/413 |
| 2,829,601 | 4/1958 | Weinfurt et al. | 417/413 |
| 3,671,151 | 6/1972 | Duke et al. | 417/413 X |
| 3,825,374 | 7/1974 | Kondo | 417/413 |

FOREIGN PATENT DOCUMENTS

| | | | |
|---|---|---|---|
| 585298 | 9/1933 | Fed. Rep. of Germany | 417/413 |
| 1403981 | 11/1968 | Fed. Rep. of Germany | 417/396 |
| 585519 | 3/1925 | France | 417/413 |
| 114302 | of 1952 | Japan . | |

*Primary Examiner*—Carlton R. Croyle
*Assistant Examiner*—Edward Look
*Attorney, Agent, or Firm*—Ladas, Parry, Von Gehr, Goldsmith & Deschamps

[57] ABSTRACT

A compact electromagnetically driven air pump comprising a valve body provided with two air inlets and two outlet pipes and a pump chamber provided on each side of the valve body, whereby two separate air passages are provided therein and said pump can supply air to two aquarium gadgets with equal pressure, is disclosed. This pump is more compact and less noisy than the prior art air pumps with two pump bodies.

6 Claims, 4 Drawing Figures

TWIN AIR PUMP

BACKGROUND OF THE INVENTION

This invention relates to an improved electromagnetic air pump for aquariums, more particularly the invention relates to a compact twin-type electromagnetic air pump for aquariums.

Electromagnetic air pumps are commonly used for bubbling air and for other purposes in aquariums in which aquatic animals and often plants are kept. An aquarium usually needs two air supply sources, one for bubbling and another for water filtration. It is not suitable to use air from an air pump for two gadgets, because air tends to flow only in the passage where the resistance is lower. For the purpose of supplying air into two passages with equal pressure, electromagnetic air pumps provided with two pump bodies are known. Such pumps are larger in size and noisy, because simply two pump bodies are contained in a housing, and two pumps often cause resonance.

This invention provides a compact electromagnetic air pump with twin pump bodies, that is, a pump comprising integrally formed two pump bodies.

SUMMARY OF THE INVENTION

According to this invention, a twin type electromagnetic air pump comprising a valve body having two outlet pipes and four valve chambers each provided with a check valve, and a pair of pump chambers each provided with a pulsating pump diaphragm, wherein the first valve chamber communicates with the atmosphere and the first pump chamber, whereby the check valve thereof allows air to flow only from the atmosphere to the first pump chamber, and said first pump chamber communicates with the third valve chamber which communicates with the first outlet pipe, whereby the check valve of said third valve chamber allows air to flow only from the first pump chamber to the first outlet pipe; the second valve chamber communicates with the atmosphere and the second pump chamber, whereby the check valve thereof allows air to flow only from the atmosphere to the second pump chamber, and said second pump chamber communicates with the fourth valve chamber which communicates with the second outlet pipe, whereby the check valve of said fourth valve chamber allows air to flow only from the second pump chamber to the second outlet pipe; and each pulsating diaphragm is pulsated by means of an arm which vibrates in accordance with the alternation of the magnetic field of an electromagnet, is provided.

In one aspect of this invention, a twin type electromagnetic air pump comprising a valve body having two outlet pipes and four valve chamber spaces each provided with a check valve, the first and the third of which open on one side of said valve body and the second and the fourth of which open on the other side of the valve body; a pair of gasket seats each provided with two air holes, each of said seats covering each of the openings of the valve chamber spaces; a pair of valve closure plates each provided with two air holes, each of said plates being secured onto each gasket seat; and a pair of pump diaphragms each of which forms a pump chamber with one of the valve closure plates; whereby the atmosphere, the first valve chamber, the first pump chamber, the third valve chamber and the first outlet pipe are communicated by means of the holes of the gasket seats and the valve closure plates so that air can flow only from the atmosphere to the first outlet pipe; and the atmosphere, the second valve chamber, the second pump chamber, the fourth valve chamber and the second outlet pipe are communicated by means of the holes of the gasket seats and the valve closure plates so that air can flow only from the atmosphere to the second outlet pipe, is provided.

In another aspect of this invention, a twin type electromagnetic air pump comprising a valve body having two outlet pipes and four valve chamber spaces, a pair of gasket seats each provided with two holes, a pair of valve elements each provided with two check valves and a pair of pump diaphragms, wherein the valve body and the gasket seats are assembled so that the latter sandwiches the former, each valve element is secured on each gasket seat, so that four valve chambers are formed, and each pump diaphragm is mounted on each valve element, so that two pump chambers are formed, whereby an air passage is formed from the atmosphere through the first valve chamber, the first pump chamber, the third valve chamber to the first outlet pipe and another air passage is formed from the atmosphere through the second valve chamber, the second pump chamber, the fourth valve chamber to the second outlet pipe, is provided.

Now the invention is explained in detail with reference to the attached drawings.

DETAILED DESCRIPTION OF THE INVENTION

Figure 1:
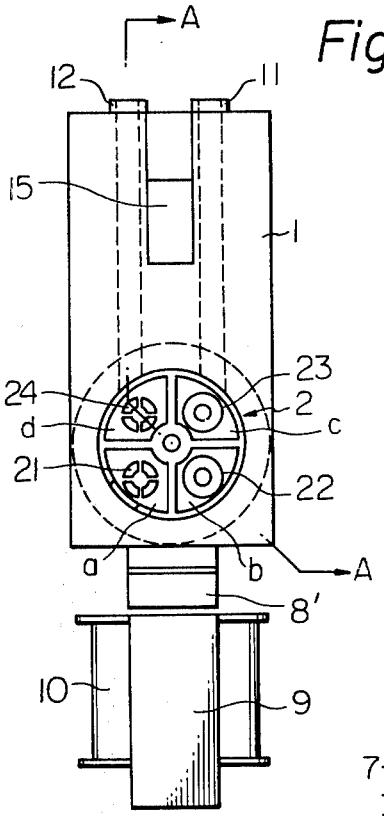
FIG. 1 is a side view of an embodiment of the twin type electromagnetic air pump of this invention showing the surface of its valve body.
Figure 2:
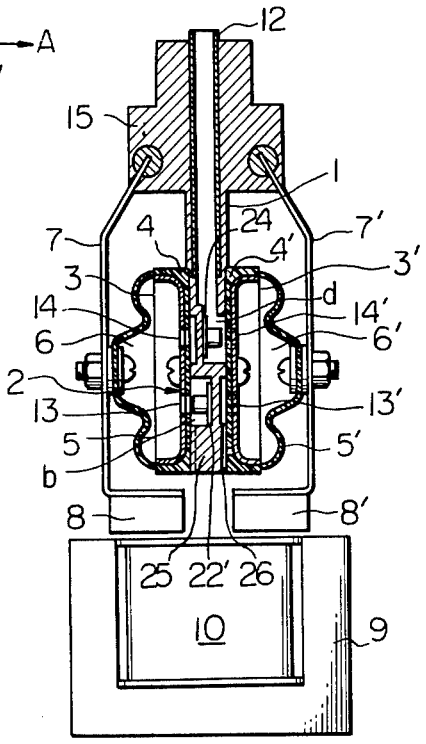
FIG. 2 is a cross-sectional view of the pump of FIG. 1 along the line A—A in FIG. 1.
Figure 3:
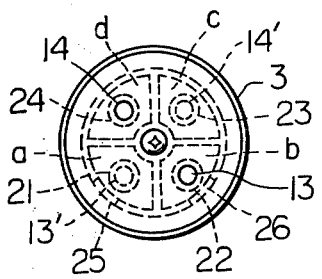
FIG. 3 is a plan view of a valve closure plate of the pump.

The pump as shown in FIGS. 1–3 comprises a valve body 1, which is formed integrally with two outlet pipes 11, 12 and a supporting portion 15; a pair of gaskets 4, 4', which cover the surfaces with openings of the valve portion of the valve body; a pair of valve closure plates 3, 3' each of which is secured to one side of the valve body with one of the gasket seats between the closure plate and the valve body; and a pair of pump diaphragm 5, 5' each of which is mounted over the one of the valve closure plates to form pump chambers 6, 6'. A pair of vibration arms 7, 7' each provided with a magnet 8, 8' at the end thereof and pivotably supported at the supporting portion 15 of the valve body are respectively secured to the center of the two pump diaphragms at their middle.

In this embodiment, as seen in FIG. 1, four fan-shaped valve chambers a, b, c and d (designated as a whole as 2), are arranged in a quadrantal pattern divided by ridges. (Generally, they need not be fan-shaped.) The first chamber a and the fourth chamber d open on this side of the drawing sheet surface and the second chamber b and the third chamber c open on the back side of the drawing sheet surface, as seen well in FIG. 2. The first chamber a is provided with a check valve 21, which consists of an air hole (a set of four fan-shaped holes in this case) and a small piece of membrane. In the same way, the second, third and fourth valve chambers (b, c and d) are respectively provided with check valves 22, 23, 24. On the opening of the valve body, gasket seats 4, 4' are placed so that the valve chambers are closed, whereby the gasket seats have a hole respectively at the position corresponding to the outlet side of the chamber a and b and the inlet side of the chamber c and d. On each of the gasket seats 4, 4', a valve closure plate 3, 3' is secured, whereby each valve closure plate is provided with a hole at the position corresponding to each hole of the gasket seat to which said plate is placed. The valve chamber a communicates with the atmosphere by means of a passage 25, which is an indentation provided in the ridge of said valve chamber. In the same way, the valve chamber b communicates with the atmosphere by a passage 26 (in FIG. 2).

In this case, the valve closure plate 3, 3' is a disc with a peripheral flange. Although the shape of the plate is not limited to a disc, the circular form is most suitable from the view point of providing air-tight closure. Over each of the valve closure seats 3, 3', a cup shaped pump diaphragm 5, 5' is secured so as to form a pump chamber 6, 6'.

As seen in FIG. 2, the fourth valve chamber d communicates with the second outlet pipe 12. In the same way, the third valve chamber c communicates with the first outlet pipe 11. The front view of the valve closure plate as secured to the valve body with a gasket seat therebetween is shown in FIG. 3. This view corresponds to FIG. 1, that is, the side of the pump chamber 6 is shown. From this figure, it is learned that air flows into the pump chamber 6 through the hole 13 from the second valve chamber b and flows out into the fourth valve chamber d through the hole 14. It will be also understood that air flows into the pump chamber 6' through the hole 13' from the first valve chamber a and flows into the third valve chamber c through the hole 14'.

To the center of each pump diaphragm, a vibration arm 7, 7' is secured at its center. One end of the arm is pivotably supported on the supporting portion 15, and to the other end thereof, a magnet 8, 8' is secured as shown in FIG. 2. Beneath the pump, a tripolar field magnet 9 with a coil 10 wound on the central pole is placed.

When alternate electric current flows through the coil, the alternation of the magnetic field takes place, and thus the vibration arms vibrate symmetrically (not parallel). Symmetrical vibration produces less noise than parallel vibration. The pump body and the field magnet are contained and fixed in a suitable container not shown.

From the above description, it will be understood that when the pump diaphragms are pulsated, air is carried from the atmosphere through the first valve chamber, the first pump chamber, and the third valve chamber to the first outlet pipe and simultaneously from the atmosphere through the second valve chamber, the second pump chamber and the fourth valve chamber to the second outlet pipe, with equal pressure.

Figure 4:
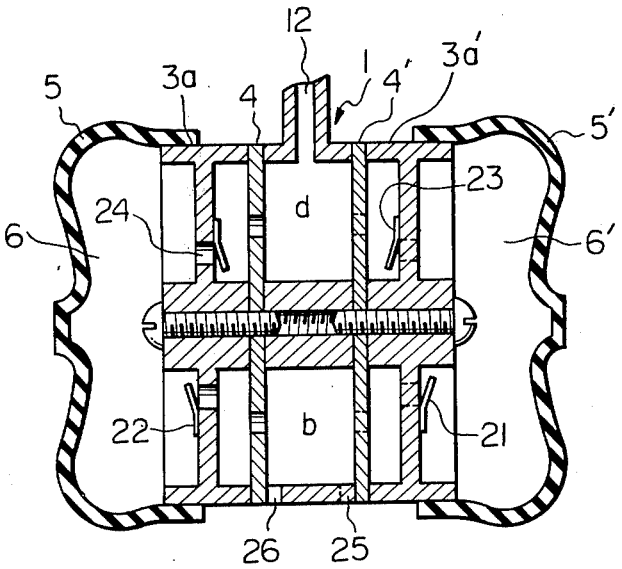
FIG. 4 is a schematic presentation of the structure of another embodiment of this invention.

FIG. 4 is a schematic representation of another embodiment of this invention. Here the valve comprises a valve body 1, a pair of gasket seat 4, 4', a pair of valve elements 3*a*, 3*a'* provided with check valves 21, 23 and 22, 24 respectively and a pair of pump diaphragms 5, 5' defining pump chambers 6, 6'. In this figure, it must be understood that valve chambers b and d, and check valves 22 and 24 are on this side of the drawing sheet surface and there is another valve chamber a behind the chamber b and another valve chamber c behind the valve chamber d. Also check valves 21 and 23 are behind the drawing sheet surface. In this construction, it will be understood that air flows from the atmosphere through the passage 26, the valve chamber b, the second pump chamber 6, and the fourth valve chamber d to the second outlet pipe 12 when the diaphragm 5 is pulsated. At the same time it will be also understood that air flows from the atmosphere through the passage 25, the first valve chamber a, the first pump chamber 6' and the third valve chamber c to the first outlet pipe in accordance with the pulsation of the diaphragm 5'.

The valve body and the valve element in the second embodiment are preferably made of a plastic material by injection molding. The valve closure plate of the first embodiment is preferably made of metal by press or die casting. The gasket seat and the diaphragm are made of any elastomeric material.

Although the invention has been explained in reference with preferred embodiments, it should be understood that various modifications are possible within the scope of the invention as defined in the attached claims.

Having described my invention, I claim:

1. An electromagnetic air pump comprising a valve body having two outlet pipes and four valve chambers each provided with a check valve, and a pair of pump chambers each provided with a pump diaphragm, wherein the first valve chamber communicates with the atmosphere and the first pump chamber, whereby the check valve thereof allows air to flow only from the atmosphere to the first pump chamber, and said first pump chamber communicates with the third valve chamber which communicates with the first outlet pipe, whereby the check valve of said third valve chamber allows air to flow only from the first pump chamber to the first outlet pipe; the second valve chamber communicates with the atmosphere and the second pump chamber, whereby the check valve thereof allows air to flow only from the atmosphere to the second pump chamber, and said second pump chamber communicates with the fourth valve chamber which communicates with the second outlet pipe, whereby the check valve of said fourth valve chamber allows air to flow only from the second pump chamber to the second outlet pipe; and the pump further comprising drive means for pulsating said pump diaphragms, the drive means comprising an electromagnet and a pair of arms which are vibrated symmetrically in accordance with the alternation of the magnetic field of the electromagnet and are connected to the diaphragms respectively.

2. The electromagnetic air pump as described in claim 1, wherein the electromagnet is a tripolar magnet with a coil wound onto the central pole.

3. The electromagnetic air pump as described in claim 1, wherein the valve body is an integrally formed plate-like body having two main faces extending substantially parallel to one another, and the four valve chambers are substantially quadrantally arranged in the plate-like body, each of the four valve chambers being separated from the two adjacent valve chambers by walls which extend substantially perpendicular to said two main faces.

4. The electromagnetic air pump as described in claim 3, further comprising first and second gasket seats and first and second valve closure plates, the valve closure plates being secured to said plate-like body at the two main faces thereof respectively with the gasket seats disposed between the plate-like body and the valve closure plates respectively, and wherein each of the valve chambers extends right through the valve body and communicates with the pumping chamber at one main face of the valve body by way of a hole in the valve closure plate secured to said one main face and a hole in the gasket seat disposed between said one main face and the valve closure plates secured thereto, and is separated from the pumping chamber at the other main face of the plate-like body by the valve closure plate secured to said other main face and the gasket seat disposed between said other main face and the valve closure plate secured thereto.

5. An electromagnetic air pump comprising an integrally formed plate-like valve body having two outlet pipes and four substantially quadrantally arranged valve chamber spaces each provided with a check valve, the first and the third of which open on one side of said valve body and the second and the fourth of which open on the other side of the valve body; a pair of gasket seats each provided with two air holes, each of said seats covering each of the openings of the valve chamber spaces, a pair of valve closure plates each provided with two air holes, each of said plates being secured onto each gasket seat; and a pair of pump diaphragms each of which forms a pump chamber with one of the valve closure plates; whereby the atmosphere, the first valve chamber, the first pump chamber, the third valve chamber and the first outlet pipe are communicated by means of the holes of the gasket seats and the valve closure plates so that air can flow only from the atmosphere to the first outlet pipe; and the atmosphere, the second valve chamber, the second pump chamber, the fourth valve chamber and the second outlet pipe are communicated by means of the holes of the gasket seats and the valve closure plates so that air can flow from the atmosphere to the second outlet pipe; and the pump further comprising drive means for pulsating said pump diaphragms, the drive means comprising a tripolar electromagnet and a pair of arms which are vibrated symmetrically in accordance with the alternation of the magnetic field of the electromagnet and are connected to the diaphragms respectively.

6. An electromagnetic air pump comprising a valve body having two outlet pipes and four valve chamber spaces, a pair of gasket seats each provided with two holes, a pair of valve elements each provided with two check valves and a pair of pump diaphragms, wherein the valve body and the gasket seats are assembled so that the latter sandwiches the former, each valve element is secured on each gasket seat, so that four valve chambers are formed, and each pump diaphragm is mounted on each valve element, so that two pump chambers are formed, whereby an air passage is formed from the atmosphere through the first valve chamber, the first pump chamber, the third valve chamber to the first outlet pipe and another air passage is formed from the atmosphere through the second valve chamber, the second pump chamber, the fourth valve chamber to the second outlet pipe, whereby the pump diaphragms are pulsated by two vibration arms which vibrate symmetrically in accordance with the alteration of the magnetic fluid of a tripolar electromagnet.

* * * * *